US010550689B2

(12) United States Patent
Ritchie et al.

(10) Patent No.: US 10,550,689 B2
(45) Date of Patent: Feb. 4, 2020

(54) METHOD AND APPARATUS FOR GENERATING A LOW FREQUENCY PULSE IN A WELLBORE

(71) Applicant: TURBO DRILL INDUSTRIES, INC., Conroe, TX (US)

(72) Inventors: Sheldon Ritchie, Conroe, TX (US); Chad Feddema, Conroe, TX (US); Malcolm Grant, Conroe, TX (US)

(73) Assignee: TURBO DRILL INDUSTRIES, INC., Conroe, TX (US)

( * ) Notice: Subject to any disclaimer, the term of this patent is extended or adjusted under 35 U.S.C. 154(b) by 0 days.

(21) Appl. No.: 15/947,645

(22) Filed: Apr. 6, 2018

(65) Prior Publication Data

US 2018/0291733 A1 Oct. 11, 2018

Related U.S. Application Data

(60) Provisional application No. 62/482,926, filed on Apr. 7, 2017.

(51) Int. Cl.

| | |
|---|---|
| ***E21B 34/06*** | (2006.01) |
| ***E21B 47/18*** | (2012.01) |
| ***E21B 28/00*** | (2006.01) |

(52) U.S. Cl.

CPC ..... *E21B 47/187* (2013.01); *E21B 28/00* (2013.01); *E21B 34/06* (2013.01)

(58) Field of Classification Search

CPC ..... E21B 47/187; E21B 28/00; E21B 34/06

See application file for complete search history.

(56) References Cited

U.S. PATENT DOCUMENTS

| | | | | |
|---|---|---|---|---|
| 2,735,653 | A | 2/1956 | Bielstein | |
| 6,555,926 | B2 | 4/2003 | Gondron | |
| 8,297,378 | B2 | 10/2012 | Hall et al. | |
| 9,004,194 | B2 | 4/2015 | Eddison et al. | |
| 9,273,529 | B2 | 3/2016 | Eddison et al. | |
| 9,494,035 | B2 | 11/2016 | Logan et al. | |
| 2007/0221409 | A1* | 9/2007 | Hall | E21B 4/14 175/61 |
| 2007/0242565 | A1 | 10/2007 | Hall et al. | |
| 2011/0056695 | A1 | 3/2011 | Downton | |

(Continued)

OTHER PUBLICATIONS

International Search Report and Written Opinion issued in PCT/US18/26585, dated Jul. 19, 2018, 11 pages.

*Primary Examiner* — David J Bagnell
*Assistant Examiner* — Yanick A Akaragwe
(74) *Attorney, Agent, or Firm* — Adolph Locklar

(57) ABSTRACT

A pressure pulse tool includes a tool housing, a valve disposed in the housing and having first and second valve components that are each rotatable relative to the housing and that cooperate to open and close a fluid flow path through the valve. The tool may include first and second power section coupled to the first and second valve components, respectively, for rotating the respective valve components. The power sections may each include a turbine rotor and the first and second rotors may have different geometries or may be powered by different amounts of fluid flow therethrough. Flowing fluid through the tool generates a pressure pulse having a desired pressure pulse frequency that may be lower than the first or second turbine rotor would generate alone.

16 Claims, 6 Drawing Sheets

(56) References Cited

U.S. PATENT DOCUMENTS

| | | | |
|---|---|---|---|
| 2016/0258287 | A1 | 9/2016 | Kolle |
| 2017/0074092 | A1 | 3/2017 | Pogrebinsky et al. |
| 2017/0268331 | A1 | 9/2017 | Lee et al. |
| 2017/0292364 | A1 | 10/2017 | Li et al. |

* cited by examiner

METHOD AND APPARATUS FOR GENERATING A LOW FREQUENCY PULSE IN A WELLBORE

CROSS-REFERENCE TO RELATED APPLICATIONS

This application is a non-provisional application which claims priority from U.S. provisional application No. 62/482,926, filed Apr. 7, 2017, which is incorporated by reference herein in its entirety.

TECHNICAL FIELD/FIELD OF THE DISCLOSURE

The present disclosure relates generally to downhole tools for use in a wellbore, and specifically to tools for generating pressure pulses in a wellbore.

BACKGROUND OF THE DISCLOSURE

When drilling a wellbore, a drill string comprising a plurality of tubular members joined end to end may be fed through a wellbore. In certain circumstances, for example while drilling a deviated or horizontal wellbore, friction between the drill string and the wellbore may cause difficulty in inserting or removing the drill string from the wellbore. Friction reduction tools (FRT) or other hydraulically actuated tools may be used to generate friction reducing forces in the drill string to temporarily reduce friction between the drill string and the wellbore. Hydraulically actuated tools may be powered by pressure pulses of drilling fluid supplied through the drill string.

Typically, pressure pulses are generated using valves coupled to positive displacement motors to achieve desired pulse frequencies. However, positive displacement motors are subject to wear and vary in speed depending on the rate of fluid flow therethrough. Positive displacement motors are also affected by temperature, condition of rubber elements within the motors, and oil based fluid.

SUMMARY

The present disclosure provides for a pressure pulse tool. The pressure pulse tool may include a tool housing. The pressure pulse tool may include a valve having a first valve component and a second valve component. The first and second valve components may be independently rotatable relative to the tool housing. The pressure pulse tool may include a first power section mechanically coupled to the first valve component. The pressure pulse tool may include a second power section mechanically coupled to the second valve component.

In some embodiments, a pressure pulse tool may comprise a tool housing, a valve disposed in the housing, the valve having a first valve component and a second valve component, the first and second valve components being each independently rotatable relative to the tool housing and cooperating to open and close a fluid flow path through the valve, a first power section mechanically coupled to the first valve component for rotating the first valve component, and a second power section mechanically coupled to the second valve component for rotating the second valve component. The valve may include a rotary plate valve, and the first and second valve components may be first and second valve plates. Each of the first and second valve plates may have one or more flow apertures. The first valve plate may further include one or more relief ports.

The valve may include a rotary valve and the first valve component may be an inner rotor and the second valve component may be a sleeve that includes one or more flow apertures. The rotor may include one or more lobes positioned to block the flow apertures for a portion of the rotation of the inner rotor relative to the sleeve.

The first and second power section may each be selected from positive displacement motors, electric motors, and turbines. In some embodiments, the first power section may include a first turbine rotor and the second power section may include a second turbine rotor. The first and second turbine rotors may have different geometries. The tool may include a fluid passage positioned to allow fluid flowing through the tool to bypass the second power section.

In some embodiments, a method for transmitting a pressure pulse in a fluid, includes a) providing a pressure pulse tool, the pressure pulse tool including a tool housing, a valve disposed in the housing, the valve having a first valve component and a second valve component, the first and second valve components being each independently rotatable relative to the tool housing and cooperating to open and close a fluid flow path through the valve, b) flowing a fluid through the pressure pulse tool, c) rotating the first valve component at a first rotation rate, d) rotating the second valve component at a second rotation rate that is different from the first rotation rate, and e) generating a pressure pulse with the valve in the drilling fluid, the pressure pulse having a pressure pulse frequency. The tool may further include a first power section mechanically coupled to the first valve component for rotating the first valve component and a second power section mechanically coupled to the second valve component for rotating the second valve component. The tool further may further include a fluid passage positioned to allow drilling fluid to bypass the second power section, and the method may further include flowing a portion of the drilling fluid through the fluid passage and not through the second power section. Step d) may include providing a first amount of power to rotate the first valve component and providing a second amount of power to rotate the second valve component, wherein the first and second amounts of power are different.

The first and second power sections may each be a turbine comprising a turbine rotor and the first and second turbine rotors may have different flow-to-rotation ratings. The difference between the flow-to-rotation rating of the first power section and the flow-to-rotation rating of the second power section may be selected so as to cause the tool to generate a pulse having a desired pressure pulse frequency at a selected flow rate.

The first and second power sections may be turbines and step b) may further include bypassing the second power section with a portion of fluid that flows through the tool. The volume of the bypassed portion may be selected so as to cause the tool to generate a pulse having a desired pressure pulse frequency at a selected flow rate.

In some embodiments, the ratio of the pressure pulse frequency to the frequency at which the valve would open if only one valve component were rotating is less than 1:2, or less than 1:4, or, in some embodiments, less than 1:5 or less than 1:10.

In some embodiments, a pressure pulse tool includes a tool housing, a valve disposed in the housing and having first and second valve components that are each rotatable relative to the housing and that cooperate to open and close a fluid flow path through the valve, first and second power section coupled to the first and second valve components, respectively, for rotating the respective valve components. The power sections may each include a turbine rotor and the first and second rotors may have different geometries or may be powered by different amounts of fluid flow therethrough. Flowing fluid through the tool generates a pressure pulse having a desired pressure pulse frequency that may be lower than the first or second turbine rotor would generate alone.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
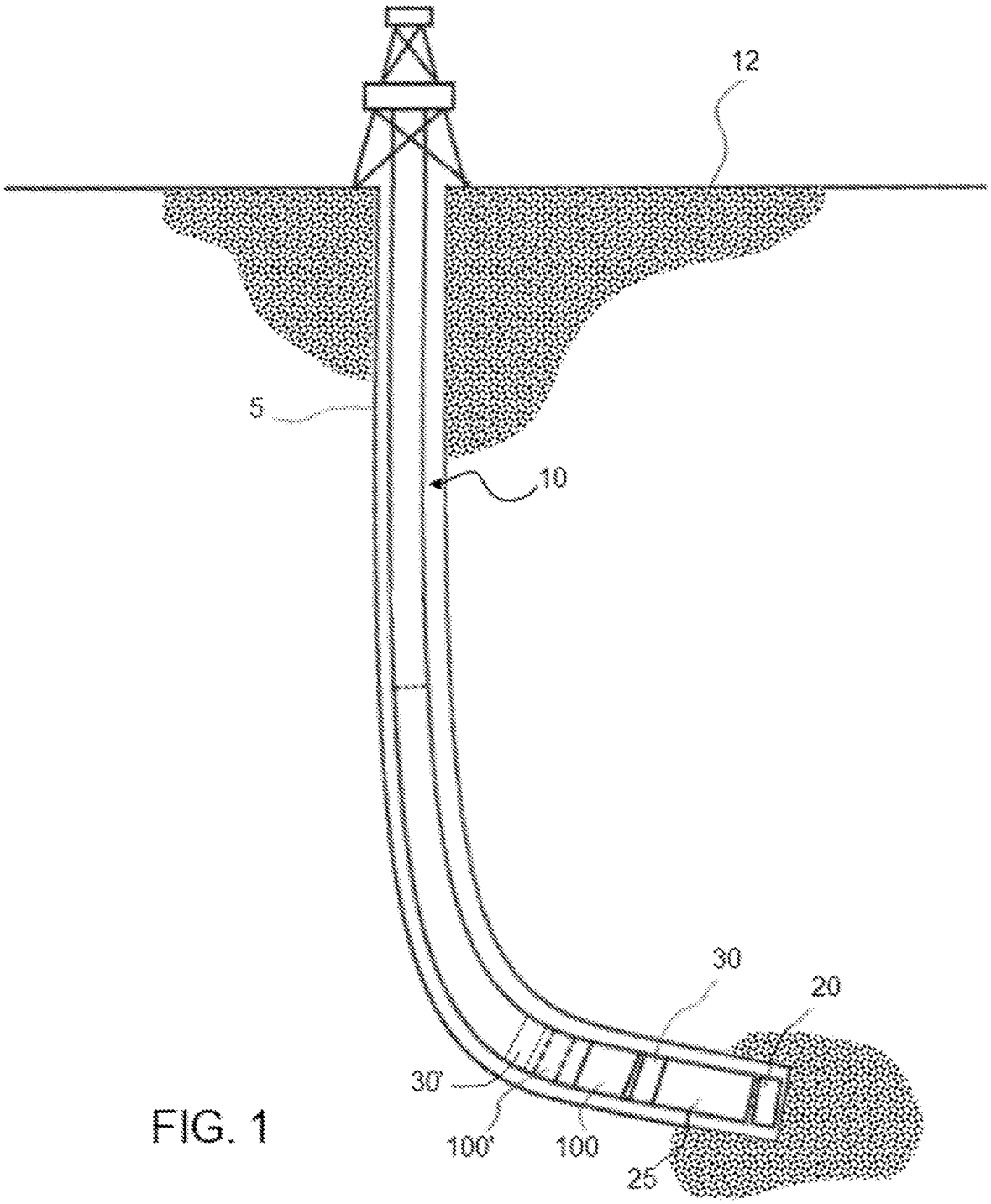
FIG. 1 depicts an overview of a drill string having a pressure pulse tool consistent with at least one embodiment of the present disclosure in a wellbore.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts an overview of a drilling operation of wellbore 5. Drill string 10 may extend through wellbore 5 from surface 12. In some embodiments, drill string 10 may be made up of a plurality of tubular members joined end to end. In some embodiments, drill string 10 may be made up of coiled tubing. In some embodiments, drill string 10 may include drill bit 20 positioned at the lower end of drill string 10. For the purposes of this disclosure, "up", "above", and "upper" denote a direction within wellbore 5 toward surface 12, and "down", "below", and "lower" denote a direction within wellbore 5 away from surface 12. Drill bit 20 may be used to form wellbore 5.

In some embodiments, drill string 10 may include bottomhole assembly (BHA) 25. BHA 25 may include, for example and without limitation, one or more of a mud motor, measurement while drilling (MWD) package, logging while drilling (LWD) package, rotary steerable system (RSS), stabilizer, and other downhole tools. In some embodiments, drill string 10 may include a hydraulically actuated tool to generate longitudinal movement in drill string 10 to temporarily reduce friction between drill string 10 and the wellbore. Hydraulically actuated tool 30, as described herein, may be any tool for generating such a mechanical longitudinal movement from a pressure pulse in the drilling fluid flowing through drill string 10, and may sometimes be referred to as an FRT or shock tool. Hydraulically actuated tool 30 may, in response to pressure pulses of drilling fluid within drill string 10, cause vibrations, impacts, or other forces to be imparted on drill string 10 below or above hydraulically actuated tool 30. Such vibrations, impacts, or other forces are referred to herein as friction reducing forces. The friction reducing forces may, for example and without limitation, be used to cause momentary reductions in friction between drill string 10 and wellbore 5 as drill string 10 is traveled through wellbore 5. Hydraulically actuated tool 30 may be positioned within BHA 25 or above BHA 25 on drill string 10. In some embodiments, hydraulically actuated tool 30 may be placed below pressure pulse tool 100. Alternatively or in addition, a hydraulically actuated tool 30', may be positioned above pressure pulse tool 100. In some embodiments, multiple hydraulically actuated tools 30 may be included within drill string 10. In some embodiments, such as where drill string 10 is a coiled tubing string, a hydraulically actuated tool may not be used.

In some embodiments, drill string 10 may include pressure pulse tool 100. Pressure pulse tool 100 may be positioned on drill string 10 above or below hydraulically actuated tool 30. Pressure pulse tool 100 may be positioned near BHA 25. In some embodiments, pressure pulse tool 100 may be positioned at any point along drill string 10, as depicted by pressure pulse tool 100'. Pressure pulse tool 100 may operate to create pressure pulses of drilling fluid passing through drill string 10. The pressure pulses generated by pressure pulse tool 100 may cause movement of drill string 10 creating friction reducing forces on drill string 10. In some embodiments, the pressure pulses generated by pressure pulse tool 100 may cause hydraulically actuated tool 30 to impart friction reducing forces on drill string 10.

Figure 2:
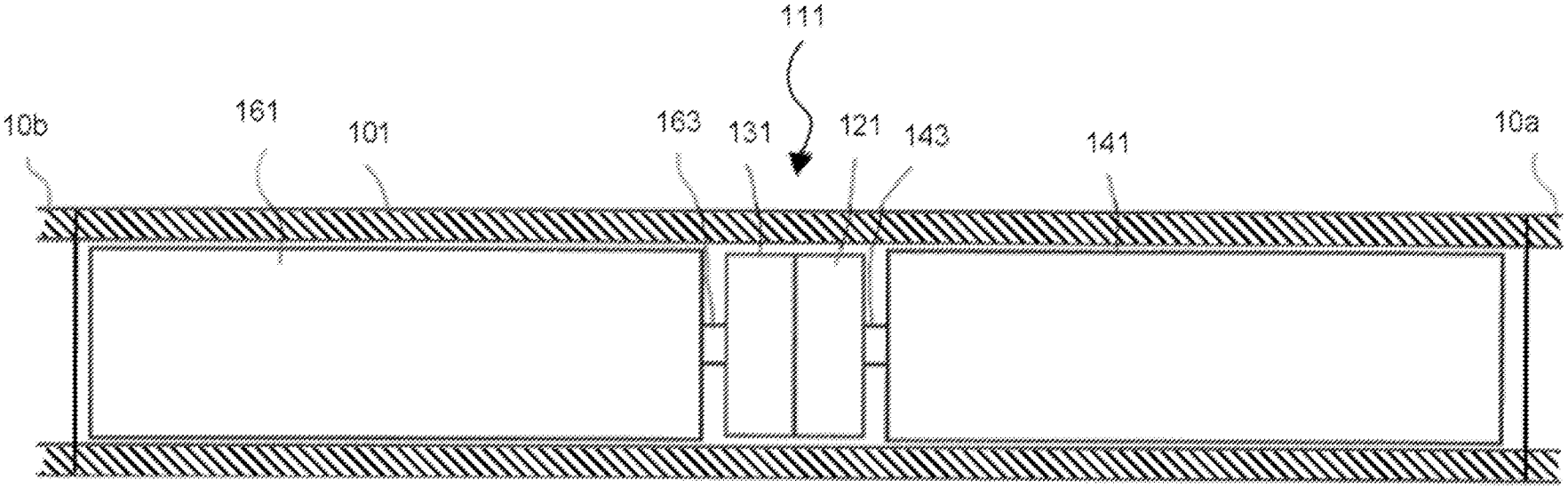
FIG. 2 depicts a schematic partial cut-away view showing a pressure pulse tool consistent with at least one embodiment of the present disclosure in a tool housing.

In some embodiments, as depicted schematically in FIG. 2, pressure pulse tool 100 may include a tool housing 101 that may be coupled to tubular members 10*a*, 10*b* of drill string 10 by, for example and without limitation, threaded couplers as known in the art. In some embodiments, tool housing 101 may allow for flow of drilling fluid through pressure pulse tool 100 during operation of pressure pulse tool 100 and may contain other components of tool housing 101. Tool housing 101 may be formed as a single member or may be made up of multiple parts.

Figure 2A:
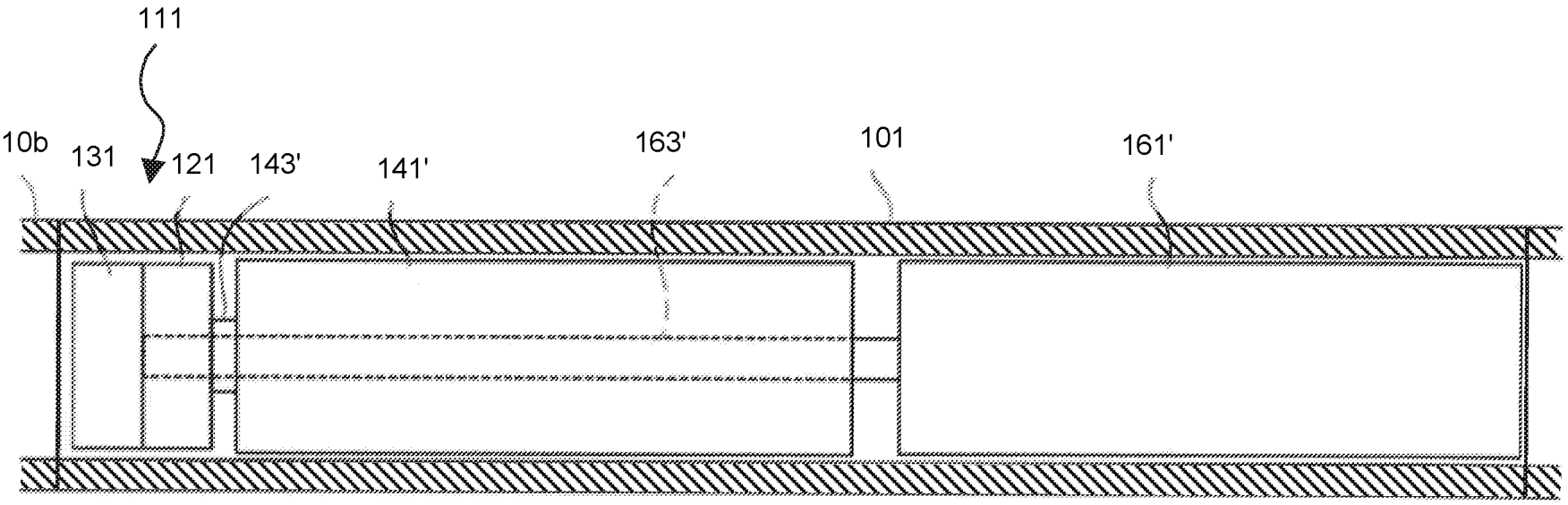
FIG. 2A depicts a schematic partial cut-away view showing a pressure pulse tool consistent with at least one embodiment of the present disclosure in a tool housing.

In some embodiments, pressure pulse tool 100 may include a valve 111. Valve 111 may be positioned to modulate at least part of the fluid flow through pressure pulse tool 100, thereby generating pressure pulses in the drilling fluid passing through valve 111. In some embodiments, valve 111 may include first and second valve components 121, 131 each independently driven by first and second power sections 141, 161 respectively. First and second power sections 141, 161 may be positioned to drive first and second valve components 121, 131 at different speeds as further discussed herein below. First and second power sections 141, 161 may be mechanically coupled to valve 111 by first and second shafts 143, 163 respectively. In some embodiments, as depicted in FIG. 2, first power section 141 may be positioned above valve 111 and second power section 161 may be positioned below valve 111. In other embodiments, as depicted in FIG. 2A, first and second power sections 141', 161' may both be positioned above valve 111 or below valve 111. In such embodiments, second shaft 163' may extend through first power section 141' and first shaft 143'.

In some embodiments, as first and second power sections 141, 161 rotate first and second valve components 121, 131 respectively, valve 111 may transition between an open position and a closed position, thereby generating pressure pulses in drill string 10. In some embodiments, valve 111 may transition between the open and closed positions a known number of times per revolution of first valve component 121 relative to second valve component 131. By rotating both first valve component 121 by first power section 141 at a first speed and second valve component 131 by second power section 161 at a second speed, the pulse frequency f (Hz) generated by pressure pulse tool 100 may be given by:

$$f = \left[\frac{|S_1 - S_2|}{60}\right] \times N$$

where $S_1$ is the rotation rate of first power section 141 in RPM, $S_2$ is the rotation rate of second power section 161 in RPM, and N is the number of times valve 111 is open per revolution of valve 111. Thus, the differential rotation rate between first and second power sections 141, 161 may determine the pulse frequency generated by valve 111. The pulse frequency f may therefore be reduced to a desired value while allowing high-speed power sections 141, 161 to be utilized and first and second valve components 121, 131 to each operate at frequencies that would be higher than desired if taken alone. In some embodiments, for example and without limitation, the pulse frequency f emitted by tool 100 may be desired to be less than 30, between 1 and 20 Hz, between 5 and 15 Hz, or between 6 and 12 Hz. Likewise, in some embodiments, the ratio of the pulse frequency to the frequency at which valve 111 would open if only one valve component were rotating may be less than 1:2, less than 1:4, less than 1:5, or less than 1:10.

Figure 3:
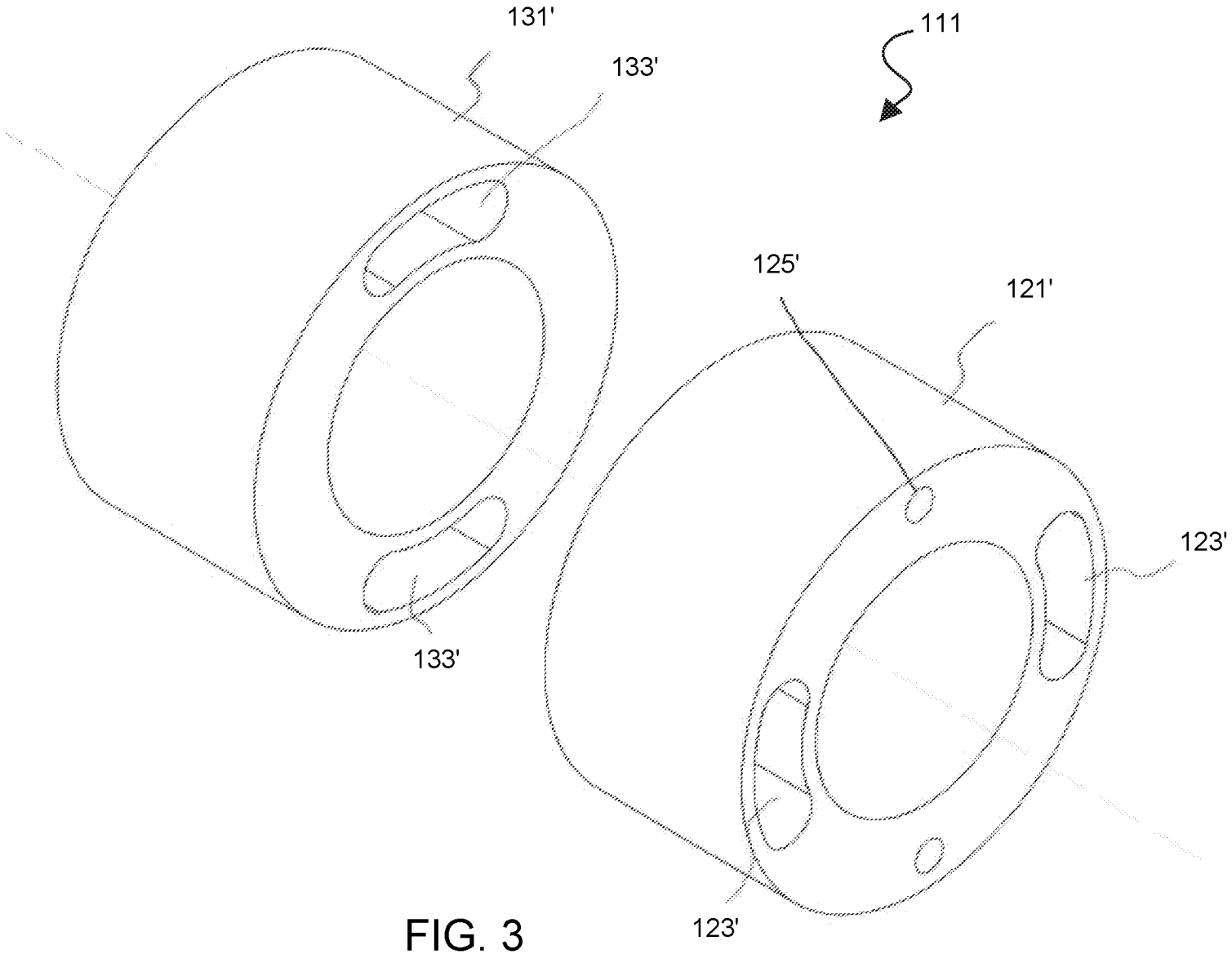
FIG. 3 depicts an exploded perspective view of a valve consistent with at least one embodiment of the present disclosure.

Valve 111 may be any type of valve capable of generating a pressure pulse in pressure pulse tool 100. For example and without limitation, in some embodiments, valve 111 may be a rotary plate valve as depicted in an exploded view in FIG. 3. Valve 111 may include first valve plate 121' and second valve plate 131'. First valve plate 121' and second valve plate 131' may be positioned in abutment or in close proximity and may be rotated relative to tool housing 101. First valve plate 121' may include flow apertures 123' extending through the length of first valve plate 121'. Second valve plate 131' may include flow apertures 133' extending through the length of second valve plate 131' such that when flow apertures 123' and flow apertures 133' are in alignment, defining an open position, fluid may flow through valve 111, and when flow apertures 123' and flow apertures 133' are not in alignment, defining a closed position, flow through valve 111 is restricted or stopped. Although depicted as having two flow apertures 123', 133', first and second valve plates 121', 131' may include any number of flow apertures 123', 133' without deviating from the scope of this disclosure. In some embodiments, first and second valve plates 121', 131' may include a different number of flow apertures 123', 133'.

In some embodiments, first valve plate 121' may include one or more relief ports 125' positioned to be in alignment with flow apertures 133' when flow apertures 123' are not in alignment with flow apertures 133'. In some embodiments, relief ports 125' may allow a lesser amount of flow through valve 111 when valve 111 is in the closed position such that, for example and without limitation, fluid flow may reach second power section 161.

Figure 4B:
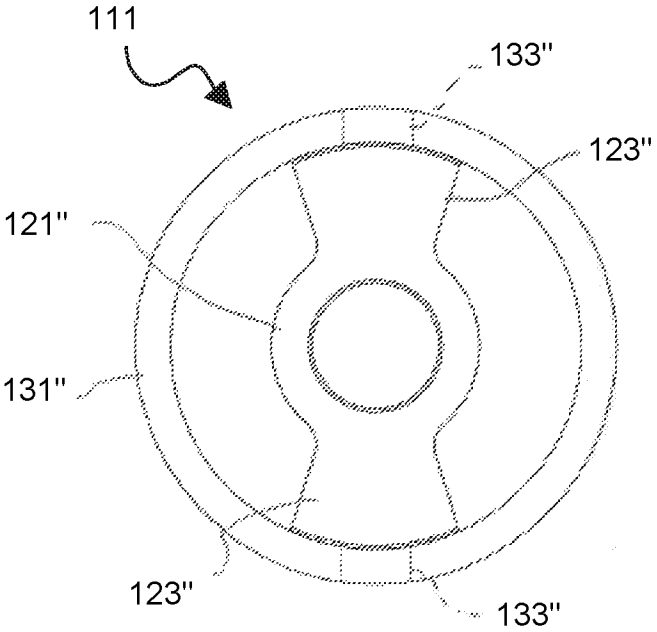
FIG. 4B depicts an end view of the valve of FIG. 4A.
Figure 4A:
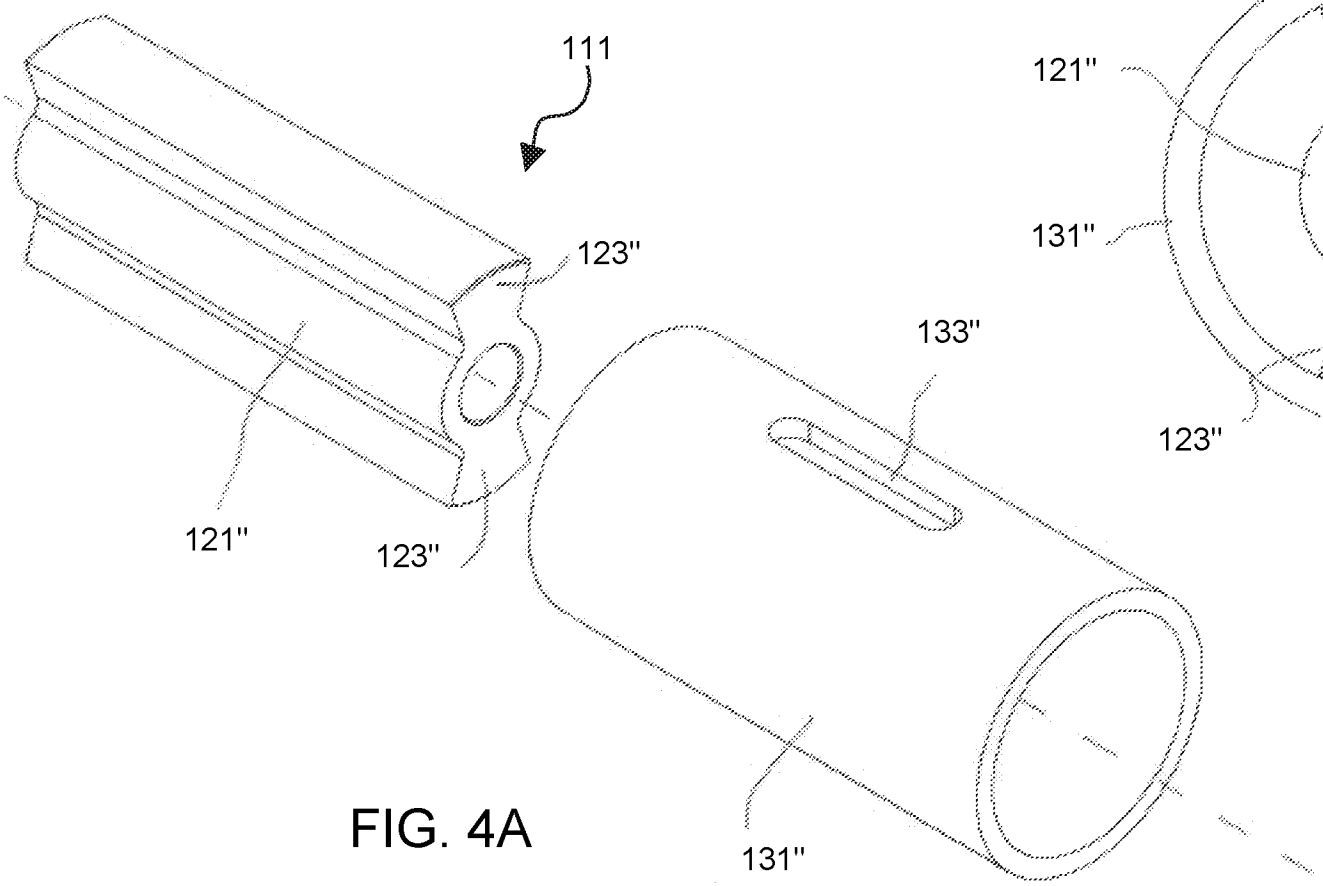
FIG. 4A depicts an exploded perspective view of a valve consistent with at least one embodiment of the present disclosure.

In some embodiments, valve 111 may be a rotary valve as depicted in FIGS. 4A, 4B. Such a valve 111 may include inner rotor 121" and sleeve 131". Inner rotor 121" may be positioned within sleeve 131" and each may be rotated relative to tool housing 101. In some embodiments, sleeve 131" may include one or more flow apertures 133" that may be opened or closed by the positioning of inner rotor 121" as inner rotor 121" rotates relative to sleeve 131". In some embodiments, inner rotor 121" may be shaped such that a flow path through each of flow apertures 133" is blocked by a lobe 123" of inner rotor 121" for a portion of the rotation of inner rotor 121" relative to sleeve 131" and is open for the remainder of rotation as the lobe 123" is not aligned with flow apertures 133". Although depicted as having two flow apertures 133", sleeve 131" may include any number of flow apertures 133" and inner rotor 121" may include any number of lobes 123". In some embodiments, the number of flow apertures 133" and lobes 123" may be different or the same.

With further reference to FIG. 2, first and second power sections 141, 161 may be any power section usable within a downhole tool to cause rotation of at least a part of valve 111. For example and without limitation, first and second power sections 141, 161 may each be one or more of a turbine power section, positive displacement motor, or electric motor. In some embodiments, first and second power sections 141, 161 may be different types of power sections.

Figure 5:
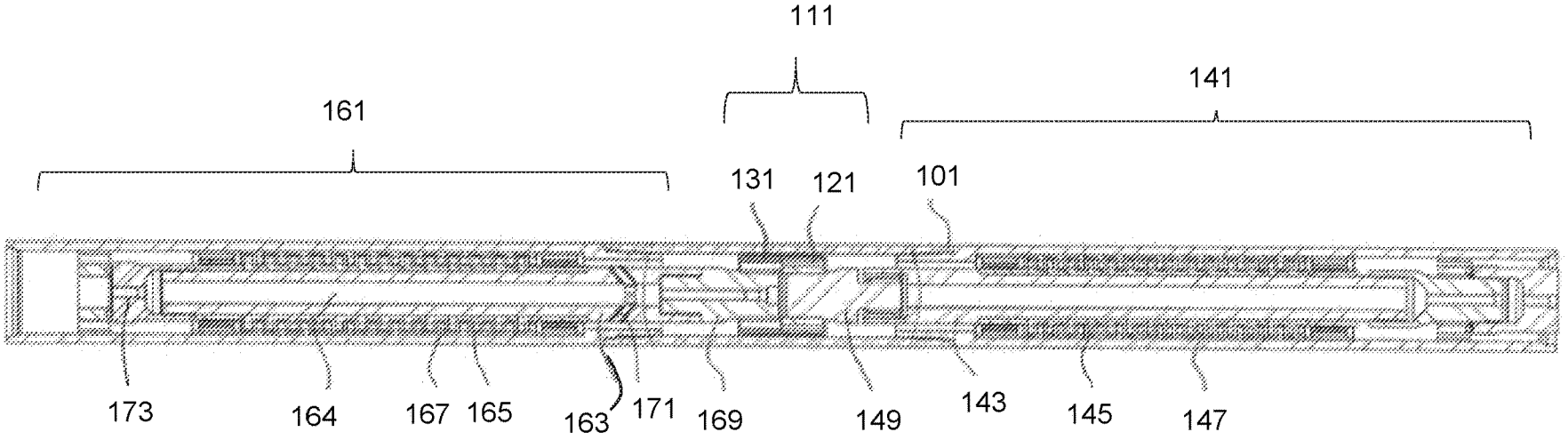
FIG. 5 depicts a cross section view of a pressure pulse tool consistent with at least one embodiment of the present disclosure.

For example and without limitation, as depicted in FIG. 5, first and second power sections 141, 161 may be turbine power sections. Although FIG. 5 depicts pressure pulse tool 100 as including valve 111 being a rotary plate valve as discussed above, pressure pulse tool 100 may include any type of valve 111 within the scope of this disclosure. In such an embodiment, first power section 141 may include first turbine rotor 145 mechanically coupled to an outer surface of first shaft 143. First shaft 143 may mechanically couple to first valve plate 121' causing rotation thereof as first shaft 143 is rotated by first turbine rotor 145 in response to fluid flow through first power section 141. In some embodiments, first power section 141 may include first turbine stator 147 mechanically coupled to tool housing 101. In some embodiments, first shaft 143 may mechanically couple to first valve plate 121' through first valve coupler 149. First shaft 143, first turbine rotor 145, first valve coupler 149, and first valve plate 121' may rotate concentrically relative to a longitudinal axis of tool housing 101.

In some embodiments, second power section 161 may include second turbine rotor 165 mechanically coupled to an outer surface of second shaft 163. Second shaft 163 may mechanically couple to second valve plate 131' causing rotation thereof as second shaft 163 is rotated by second turbine rotor 165 in response to fluid flow through second power section 161. In some embodiments, second power section 161 may include second turbine stator 167 mechanically coupled to tool housing 101. In some embodiments, second shaft 163 may mechanically couple to second valve plate 131' through second valve coupler 169. Second shaft 163, second turbine rotor 165, second valve coupler 169, and second valve plate 131' may rotate concentrically relative to the longitudinal axis of tool housing 101.

In some embodiments, first and second power sections 141, 161 may be made to rotate at different speeds by varying the geometry or size of first and second turbine rotors 145, 165. In some embodiments, first and second power sections 141, 161 may be made to rotate at different speeds by varying the amount of drilling fluid flowing through and therefore the pressure drop across one or both of turbine rotors 145, 165.

For example, in some embodiments, one or more fluid passages 171 may be positioned after valve 111 to allow a portion of the drilling fluid to bypass second turbine rotor 165. In some such embodiments, fluid passages 171 may be formed in first shaft 143 or second shaft 163 and may fluidly couple to a bore 164 in second shaft 163. In some embodiments, a nozzle may be positioned outside tool housing 101 to bypass fluid around second power section 161. In some embodiments, a restriction 173 may be positioned to reduce the amount of fluid or cause a restriction in fluid flow through bore 164. Restriction 173 may be, for example and without limitation, a nozzle, a variable nozzle, or an automated choke valve may be used.

In some embodiments, by bypassing a portion of the fluid flow through one of the second turbines, the pulse frequency f may be generally constant through a range of flow rates of drilling fluid through pressure pulse tool 100 due to the substantially linear response, within a range of flow rates, between the rotation rates of first and second turbine rotors 145, 165 and the flow rates therethrough. The following table is not intended to limit the disclosure but to exemplify the relationship between flow rate and pulse frequency f in an embodiment in which 100 gallons per minute (GPM) is bypassed from second turbine rotor 165 for exemplary first and second turbine rotors 145, 165 having 2.34 revolutions per gallon turbine bladings:

| Flow Rate through 145 (GPM) | S1 (RPM) | Flow Rate through 165 (GPM) | S2 (RPM) | RPM difference | 2 Pulses/Rev (Hz) |
|---|---|---|---|---|---|
| 400 | 936 | 300 | 702 | 234 | 7.8 |
| 425 | 994.5 | 325 | 760.5 | 234 | 7.8 |
| 450 | 1053 | 350 | 819 | 234 | 7.8 |
| 475 | 1111.5 | 375 | 877.5 | 234 | 7.8 |
| 500 | 1170 | 400 | 936 | 234 | 7.8 |
| 525 | 1228.5 | 425 | 994.5 | 234 | 7.8 |
| 550 | 1287 | 450 | 1053 | 234 | 7.8 |
| 575 | 1345.5 | 475 | 1111.5 | 234 | 7.8 |
| 600 | 1404 | 500 | 1170 | 234 | 7.8 |
| 625 | 1462.5 | 525 | 1228.5 | 234 | 7.8 |

In some embodiments, fluid passages 171 or the nozzle may be sized to generate a desired reduction in flow rate through second power section 161. In some embodiments, fluid passages 171 or the nozzle may be replaceable to modify the pulse frequency f without changing first or second turbine rotors 145, 165.

In some embodiments, a continuous bore may be formed through first shaft 143, valve 111, and second shaft 163. In some embodiments, the continuous bore may be used to bypass fluid through pressure pulse tool 100 without entering first or second power sections 141, 161. In some embodiments, the bore may be selectively opened or closed, or the flow paths to first and second power sections 141, 161 may be selectively opened or closed by a downhole actuation tool or downhole indexer. In some embodiments, the continuous bore may be used to run, for example and without limitation, a wireline tool or other downhole tool through pressure pulse tool 100. Thus, in some embodiments, the flow of fluid through the components of the tool may be controlled so as to generate a pressure pulse that has a desired pressure pulse frequency that is lower than the first or second turbine rotor could generate by itself.

It will be understood that the pressure pulses generated according to the apparatus and methods described herein can be used in any downhole application in which a pressure pulse in the downhole fluid is desired. Such applications may include friction reduction and/or telemetry.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A pressure pulse tool comprising:

a tool housing;

a valve disposed in the housing, the valve having a first valve component and a second valve component;

a first power section mechanically coupled to the first valve component and configured to rotate the first valve component in response to fluid flow through the first power section; and a second power section mechanically coupled to the second valve component and configured to rotate the second valve component in response to fluid flow through the second power section;

wherein the first and second valve components are each independently rotatable relative to the tool housing; and wherein during operation the first and second valve components cooperate to open and close a fluid flow path through the valve at a desired frequency by rotating at different rates.

2. The pressure pulse tool of claim 1 wherein the valve comprises a rotary plate valve, the first and second valve components being first and second valve plates, wherein each of the first and second valve plates includes one or more flow apertures.

3. The pressure pulse tool of claim 2 wherein the first valve plate further including one or more relief ports.

4. The pressure pulse tool of claim 1 wherein the valve comprises a rotary valve, the first valve component being an inner rotor and the second valve component being a sleeve, the sleeve including one or more flow apertures, the rotor including one or more lobes positioned to block the flow apertures for a portion of the rotation of the inner rotor relative to the sleeve.

5. A pressure pulse tool comprising:

a tool housing; and a valve disposed in the housing, the valve having a first valve component and a second valve component;

a first power section mechanically coupled to the first valve component and configured to rotate the first valve component in response to fluid flow through the first power section; and a second power section mechanically coupled to the second valve component and configured to rotate the second valve component in response to fluid flow through the second power section for rotating the second valve component;

wherein the first and second valve components are each independently rotatable relative to the tool housing;

wherein the first and second power sections are each selected from the group consisting of positive displacement motors, and turbines.

6. The pressure pulse tool of claim 5 wherein the first and second power sections are each a turbine and wherein the first and second turbines have different flow-to-rotation ratings and wherein the difference between the flow-to-rotation rating of the first power section and the flow-to-rotation rating of the second power section is selected so as to cause the tool to generate a pulse having a desired pressure pulse frequency at a selected flow rate.

7. The pressure pulse tool of claim 6 wherein the valve includes a fluid passage positioned to allow fluid flowing through the tool to bypass one of the first and second turbines.

8. A method for transmitting a pressure pulse in a fluid, comprising:

a) providing a pressure pulse tool, the pressure pulse tool including:

a tool housing;

a valve disposed in the housing, the valve having a first valve component and a second valve component, the first and second valve components being each independently rotatable relative to the tool housing and cooperating to open and close a fluid flow path through the valve; and a first power section mechanically coupled to the first valve component for rotating the first valve component in response to fluid flow and a second power section mechanically coupled to the second valve component for rotating the second valve component in response to fluid flow;

wherein the first and second power sections have different flow-to-rotation ratings; and wherein the difference between the flow-to-rotation rating of the first power section and the flow-to-rotation rating of the second power section is selected so as to cause the tool to generate a pulse having a desired pressure pulse frequency at a selected flow rate;

b) flowing a fluid through the pressure pulse tool;

c) rotating the first valve component at a first rotation rate;

d) rotating the second valve component at a second rotation rate that is different from the first rotation rate; and e) generating a pressure pulse with the valve in the drilling fluid, the pressure pulse having a pressure pulse frequency.

9. The method of claim 8 wherein the tool further comprises a fluid passage positioned to allow drilling fluid to bypass at least one power section and step b) comprises flowing a portion of the drilling fluid through the fluid passage and not through the bypassed power section.

10. The method of claim 8 wherein the first and second power sections are turbines and wherein step b) further includes bypassing one of the power sections with a portion of fluid that flows through the tool.

11. The method of claim 8 wherein the pressure pulse frequency is less than 30 Hz.

12. The method of claim 8 wherein the pressure pulse frequency is less than 15 Hz.

13. The method of claim 8 wherein the ratio of the pressure pulse frequency to the frequency at which the valve would open if only one valve component were rotating is less than 1:5.

14. The method of claim 8 wherein step d) includes providing a first amount of power to rotate the first valve component and providing a second amount of power to rotate the second valve component, wherein the first and second amounts of power are different.

15. The method of claim 8 wherein the pressure pulse is used to reduce friction in the hole.

16. A method for transmitting a pressure pulse in a fluid, comprising:

a) providing a pressure pulse tool, the pressure pulse tool including:

a tool housing;

a valve disposed in the housing, the valve having a first valve component and a second valve component, the first and second valve components being each independently rotatable relative to the tool housing and cooperating to open and close a fluid flow path through the valve; and a first power section mechanically coupled to the first valve component for rotating the first valve component and a second power section mechanically coupled to the second valve component for rotating the second valve component b) flowing a fluid through the pressure pulse tool and bypassing one of the power sections with a portion of fluid that flows through the tool;

c) rotating the first valve component at a first rotation rate;

d) rotating the second valve component and a second rotation rate that is different from the first rotation rate; and e) generating a pressure pulse with the valve in the drilling fluid, the pressure pulse having a pressure pulse frequency further including the step of selecting the volume of the bypassed portion so as to cause the tool to generate a pulse having a desired pressure pulse frequency at a selected flow rate.

* * * * *